US009316201B2

(12) United States Patent
Gruber

(10) Patent No.: US 9,316,201 B2
(45) Date of Patent: Apr. 19, 2016

(54) LASER SPARK PLUG

(71) Applicant: GE Jenbacher GmbH & Co OG, Jenbach (AT)

(72) Inventor: Friedrich Gruber, Hippach (AT)

(73) Assignee: GE JENBACHER GMBH & CO OG, Jenbach (AT)

( * ) Notice: Subject to any disclaimer, the term of this patent is extended or adjusted under 35 U.S.C. 154(b) by 231 days.

(21) Appl. No.: 14/051,648

(22) Filed: Oct. 11, 2013

(65) Prior Publication Data

US 2014/0109855 A1 Apr. 24, 2014

(30) Foreign Application Priority Data

Oct. 19, 2012 (AT) ..... A1131/2012

(51) Int. Cl.
*F02P 23/04* (2006.01)

(52) U.S. Cl.
CPC ..... *F02P 23/04* (2013.01)

(58) Field of Classification Search
CPC ..... F02P 23/04
USPC ..... 123/143 B; 250/225, 503.1
See application file for complete search history.

(56) References Cited

U.S. PATENT DOCUMENTS 5,162,660 A * 11/1992 Popil ..... G01B 11/303 250/225
8,712,197 B2 4/2014 Herden et al.
2010/0031909 A1* 2/2010 Herden ..... F02P 17/12 123/143 B
2010/0252546 A1 10/2010 Herden et al.
2011/0041793 A1* 2/2011 Weinrotter et al. ..... 123/143 B
2012/0210969 A1* 8/2012 Gruber et al. ..... 123/143 B
2014/0109855 A1* 4/2014 Gruber ..... 123/143 B

FOREIGN PATENT DOCUMENTS

DE 10 2006 029 989 1/2008
DE 102007043115 A1 3/2009
DE 102007044010 A1 3/2009
DE 10 2009 000 911 8/2010

(Continued)

OTHER PUBLICATIONS

Griffiths, Jonathan David, and Jonathan Lawrence. "Laser cleaning of the output window in a laser ignition system for gas turbines." (2012).*

(Continued)

*Primary Examiner* — Thomas Moulis
*Assistant Examiner* — Joshua A Campbell
(74) *Attorney, Agent, or Firm* — Wenderoth, Lind & Ponack, L.L.P.

(57) ABSTRACT

A laser spark plug for an internal combustion engine, in particular for a gas engine, includes a laser crystal integrated into the laser spark plug and a combustion chamber optical unit. Laser light pulses issuing from the laser crystal can be coupled by way of the combustion chamber optical unit into a combustion chamber of the internal combustion engine. An optical laser light sensor is integrated into the laser spark plug, and the combustion chamber optical unit is provided with a preferably curved reflection surface which faces towards the laser light sensor and has a reflective mirroring. At least a part of a laser light reflected at the reflection surface during the duration of a laser light pulse can be detected by the laser light sensor.

20 Claims, 2 Drawing Sheets

(56) References Cited

FOREIGN PATENT DOCUMENTS

| | | | | |
|---|---|---|---|---|
| DE | 102011089305 | A1 | | 6/2013 |
| JP | 2003-56385 | | | 2/2003 |
| JP | 2012-189044 | | | 10/2012 |
| JP | 2012189044 | A | * | 10/2012 |

OTHER PUBLICATIONS

Austrian Patent Office Search Report (ASR) issued Mar. 15, 2013 in Austrian Patent Application No. A 1131/2012.

Unofficial English translation of Office Action issued in connection with corresponding DE Application No. 102013015692.0 on Jul. 7, 2015.

* cited by examiner

LASER SPARK PLUG

BACKGROUND OF THE INVENTION

The present invention concerns a laser spark plug, an internal combustion engine having such a laser spark plug, and a method of ascertaining the operating condition of such a laser spark plug.

In laser ignition systems based on laser spark plugs of the general kind set forth, the ignition sparks are produced by focusing an intensive laser light pulse which lasts for only a few nanoseconds on the ignition location in the combustion chamber of the internal combustion engine. The laser light can be produced, for example, by a pump laser and an ignition laser (for example a laser crystal) connected downstream of the pump laser. A semiconductor laser which emits light over a plurality of milliseconds and which charges up the ignition laser is used as the pump laser. The ignition laser then delivers a laser light pulse which is in the order of nanoseconds in length and which is introduced into the combustion chamber of the internal combustion engine by way of the combustion chamber window.

Production of the laser light can suffer degradation over the operating time of the internal combustion engine, and the combustion chamber window through which the laser light pulse is introduced into the combustion chamber can suffer from transmission losses due to deposits at the surface towards the combustion chamber.

In total, the above issues can result in a considerable weakening in the ignition spark or (as a consequence) worsening of combustion in the internal combustion engine.

DE 10 2009 000 911 A1 discloses an ignition spark plug having at least one optical sensor which is integrated into the laser spark plug and which serves to monitor the energy content of the pump radiation for the laser crystal. However, that specification does not show detection of the ignition energy or light intensity which is actually of interest, being produced by the ignition laser or the laser crystal which is integrated into the laser spark plug. JP 2012-189044 A shows that a part of the light delivered by an ignition laser in the direction of the pump laser feeding the ignition laser is detected. In that case, light from the ignition laser that is delivered by the ignition laser in a direction away from the combustion chamber is detected. That detection also cannot provide any information as to how high the level of light intensity of the laser light is, which is delivered in the direction of the combustion chamber, in order to trigger an ignition spark.

SUMMARY OF THE INVENTION

The object of the invention is to provide a laser spark plug of the general kind set forth, an internal combustion engine, and a method of ascertaining the operating condition of such a laser spark plug, which makes it possible to implement condition monitoring in respect of the energy content of the ignition energy coming from the ignition spark plug.

That object is attained by an ignition spark plug as described below, an internal combustion engine having such a laser spark plug, and a method as described below.

By virtue of the mirror deflection of a part of a laser light pulse at the mirrored or partially mirrored reflection surface of the combustion chamber optical means on to the laser light sensor which for example can be in the form of a photodiode, it is possible to detect or sense the light intensity of the laser light pulses issuing from the laser crystal. In the case of laser spark plugs known in the state of the art, the radiation of a pump laser feeding the laser crystal is detected. However, it is possible with the proposed solution to detect the light intensity, which is actually of interest, of the laser light pulses of the laser crystal.

It is preferable in that respect that the combustion chamber optical means includes a convergent lens, and the convergent lens is provided with the reflection surface, preferably in the edge region of the convergent lens. The location of the mirrored reflection surface at the usually curved surface of the convergent lens can in that case preferably be selected so that the beam path of the part of a laser light pulse reflected at that mirroring leads to the laser light sensor provided for detection of that reflected laser light.

To reduce the influence of troublesome ambient light or stray light during detection of the reflected laser light, an optical aperture can be connected upstream of the laser light sensor in the direction of the beam path of the laser light incident in the laser light sensor. A specifically targeted orientation of the laser light beam on to the mirrored reflection surface and the provision of an optical aperture can thus ensure that the laser light sensor detects substantially exclusively the reflected laser light.

Generally, the ignition energy is afforded by the laser crystal of the laser spark plug, and the radiation of a pump laser is coupled into the laser crystal. For adjustment of the ignition energy, the pump output and/or the pump duration of the pump laser is or are adjusted, preferably by adjusting the current strength of a pump current feeding the pump laser.

In that case, adjustment of the current strength of the pump current can be effected for example in such a way that, starting from a stored or predeterminable cylinder-specific optimum current strength, the current strength is slightly altered downwardly and upwardly and the maximum laser light power or the maximum laser light intensity detected by the laser light sensor is ascertained depending on the current strength. That value can then be stored in a storage means as a new value for the optimum current strength.

In a particularly preferred variant, integrated in the laser spark plug is an additional optical stray light sensor by which at least a part of a stray light which is scattered back during the duration of a laser light pulse by the combustion chamber optical means can be detected. In particular, the combustion chamber optical means includes a combustion chamber window with a coupling-in surface which delimits the combustion chamber, at least a part of the stray light scattered back by the coupling-in surface can be detected by the stray light sensor. In that arrangement, the additional stray light sensor can preferably be arranged so that it precisely does not sense or detect the laser light reflected at the mirrored reflection surface, but a part of the scatter light which comes from reflections at various regions of the beam path of the laser light pulses. As the stray light which is in the interior of the laser spark plug comes in particular from laser light pulses which are scattered back at the coupling-in surface of the combustion chamber window, it is thus possible to detect in particular that stray light which is scattered back from the coupling-in surface.

In the case of a clean combustion chamber window (without deposits), no or almost no radiation should be scattered back into the laser spark plug. The integration of an additional optical stray light sensor into the laser spark plug, by way of which back-scattered radiation can be detected, therefore makes it possible in principle to ascertain the deposit-induced transmission losses at the combustion chamber window by measurement of the radiation which is scattered back in respect of the laser light pulse at the coupling-in surface. As the transmission losses occurring in the case of a clean new combustion chamber window are known (for example by previous calibration, also when the machine is stopped), it is thus possible to conclude that there is a deterioration.

The deposits at the combustion chamber side of the coupling-in surface depend in particular on the conditions of use and the time of use of the laser spark plug. If there is an evaluation unit, light intensities of the laser light detectable by the laser light sensor and the stray light detectable by the stray light sensor can be compared by the evaluation unit and a difference value in respect of the light intensities of detected laser light and detected stray light can be outputted by the evaluation unit, it is thus possible to conclude the degree of fouling of the combustion chamber window by forming the difference in respect of the measurement signals of the two optical sensors.

It is possible in that way in particular to initiate suitable measures for ensuring proper engine operation. For example, the pump output and the pump duration of a pump laser feeding the laser crystal can be suitably adapted. It is, however, also possible to initiate cleaning procedures or a need for maintenance can be displayed in good time.

Preferably, depending on the comparison of detected laser light with detected stray light, it is possible to arrive at a conclusion about transmittance of the combustion chamber optical means, preferably the combustion chamber window of the combustion chamber optical means. The ignition energy can be adjusted depending on the transmittance of the combustion chamber optical means or the combustion chamber window, respectively.

It is also possible to provide a further optical sensor which is integrated into the laser spark plug and which has a frequency sensitivity which is different relative to the laser light sensor and/or stray light sensor. For example, the laser light sensor and/or the stray light sensor can be matched to the wavelength of the laser light pulses passing into the combustion chamber, and the further optical sensor is matched to the main emission spectrum of the combustion light.

That differing frequency sensitivity of the further optical sensor relative to the laser light sensor or the stray light sensor respectively and/or the differing time of detection of the radiation by the respective sensors can be used to distinguish between an ignition event in the combustion chamber and subsequent combustion.

In addition, by quantifying the transmittance or the transmission losses on the basis of the deposits at the combustion chamber window, it is also possible to correct the measurement values detected by the further optical sensor for the light intensity from the combustion chamber.

The optical sensors (laser light sensor, stray light sensor, further optical sensor) are preferably arranged in a region of the ignition spark plug between the combustion chamber optical means and the laser crystal. For thermal and optical reasons, it is advantageous for them to be positioned at the housing wall at the maximum spacing relative to the combustion chamber optical means or the combustion chamber window thereof.

It is possible with the invention to implement various control strategies:

- detection or quantification of a degradation of the ignition laser,
- indication of service measures (for example cleaning of the combustion chamber window),
- ascertaining the fouling rate of the combustion chamber window depending on the running time of the engine (trend analysis), and estimating the remaining running time until the limit value for combustion chamber window fouling is reached or indication of service activities,
- inclusion of the transmission losses at the combustion chamber window for correct assessment of the combustion light from the combustion chamber, that is detected by the further optical sensor,
- adjusting the laser pulse power and the number of pulses on the basis of the ascertained transmission value and degradation of the pump laser, and
- ascertaining combustion-relevant parameters from the ratio of the amplitudes of the intensity ratios that vary in respect of time of the light intensities ascertained by the optical sensor (combustion-relevant parameters are inter alia: combustion misfires, lambda, ignition delay, combustion duration, load, knocking, incandescent ignition).

Generally, in each case, the optical sensor or sensors is or are not themselves placed at the specified positions, but a respective light guide member is connected upstream of the sensor or sensors and the inlet of the light guide is placed at the described positions. In that way, the sensors themselves can be placed independently of the position for detection of the radiation.

Preferably, photodiodes are used as the optical sensors. The internal combustion engine is preferably in the form of a (in particular stationary) gas engine (gas Otto-cycle engine).

BRIEF DESCRIPTION OF THE DRAWINGS

Further advantages and details of the invention will be apparent from the Figures and the related description. In the Figures.

DETAILED DESCRIPTION OF THE INVENTION

Figure 1:
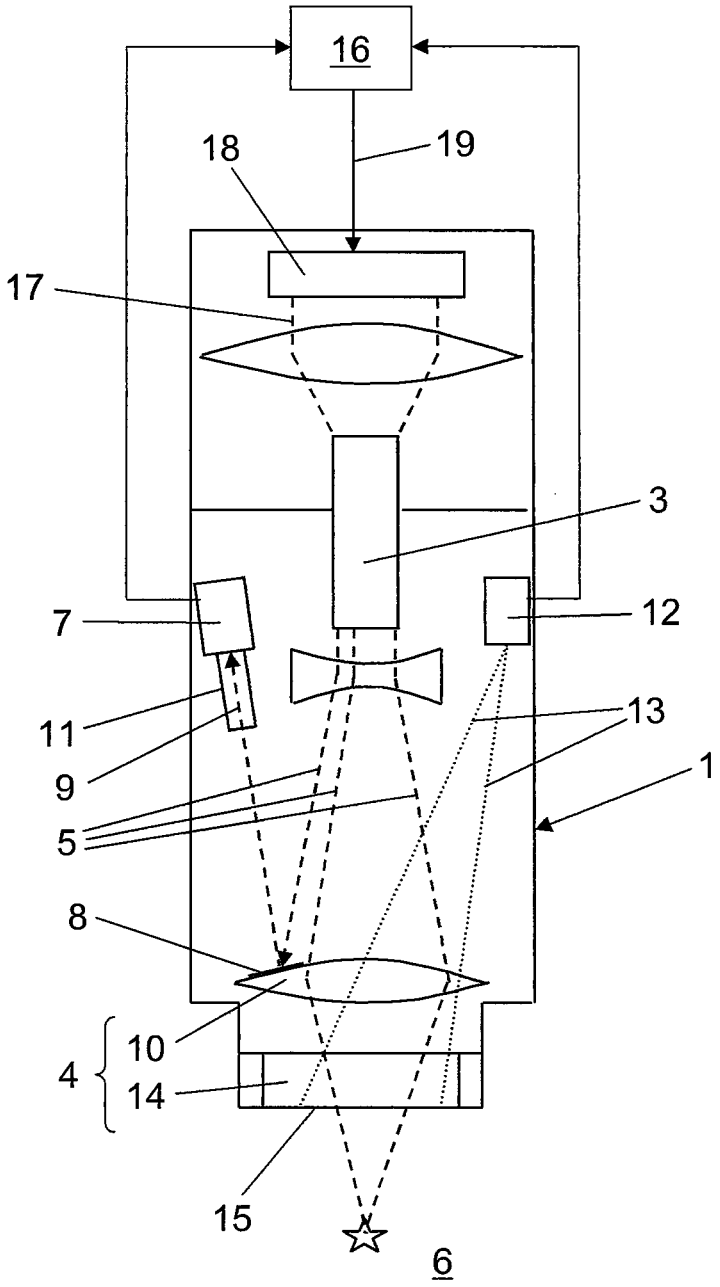
FIG. 1 is a diagrammatic view of a proposed laser spark plug.

FIG. 1 shows a proposed laser spark plug 1 having an integrated laser crystal 3 which, for example, can be in the form of an Nd:YAG pulsed laser. The laser crystal 3 is fed with pump energy in the form of radiation 17 by a pump laser 18. The laser light pulses 5 issuing from the laser crystal 3 are coupled into a combustion chamber 6 of an internal combustion engine 2 (not shown further here) by way of a combustion chamber optical unit 4. In this example, the combustion chamber optical unit 4 includes a convergent lens 10 and a combustion chamber window 14 having a coupling-in surface 15 which delimits the combustion chamber 6 and by way of which the laser light pulses 5 are coupled into the combustion chamber 6. In the edge region, the convergent lens 10 has a reflection surface 8 which has a configuration corresponding to its curved surface and which has a reflective mirroring in order to reflect laser light pulses 5 incident thereon to a suitably placed laser light sensor 7, as laser light 9. Arranged at the laser light sensor 7 is an optical aperture 11 so that the laser light sensor 7 primarily detects the reflected laser light 9 and that detection does not have unwantedly entering stray light 13 superimposed thereon.

An optical stray light sensor 12 additionally integrated in the laser spark plug 1 detects a stray light 13 formed by back-scattering of the laser light pulses 5 at the combustion chamber optical unit 4. As a large part of that stray light 13 is formed by back-scattering of the laser light pules 5 at the coupling-in surface 15 of the combustion chamber window 14, which surface is fouled at the combustion chamber side by deposits, that stray light sensor 12 serves primarily to detect the stray light 13 which is scattered back from that coupling-in surface 15.

The light intensities of the reflected laser light 9 and the stray light 13, respectively, that are detected by the laser light sensor 7 and the stray light sensor 12, are outputted in the form of optical or corresponding electrical signals to an evaluation unit 16 which compares those light intensities and performs an operation for determining the difference between those measurement signals. As a further consequence, depending on the difference in the detected light intensities, it is then possible to conclude about the fouling or the transmittance of the combustion chamber window 14 and the ignition energy can be suitably adjusted depending on the transmittance of the combustion chamber window. That can be effected by the current strength of a pump current 19 feeding the pump laser 18 (for example a VCSEL pump laser) being suitably adjusted to appropriately alter the pump output and/or the pump duration of the pump laser 18.

Figure 2:
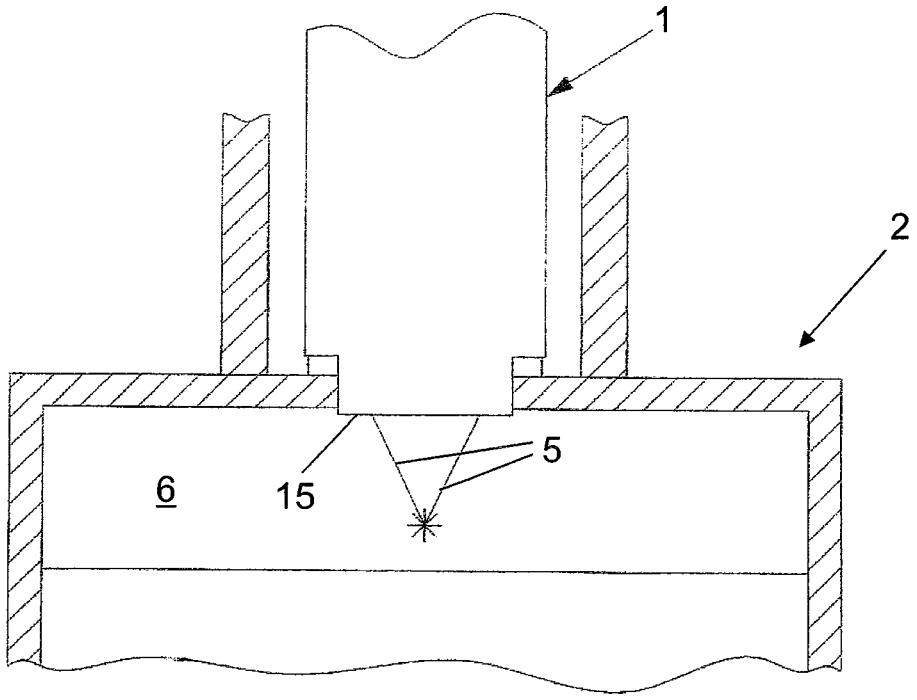
FIG. 2 is a diagrammatic view of a proposed internal combustion engine.

FIG. 2 diagrammatically shows the arrangement of the laser spark plug 1 relative to a combustion chamber 6 of an internal combustion engine 2 which is not shown in greater detail here because it corresponds to the state of the art.

The invention claimed is:

1. A laser spark plug for an internal combustion engine, comprising:

an integrated laser crystal for emitting laser light pulses towards a combustion chamber of the internal combustion engine;

a combustion chamber optical unit configured to couple the laser light pulses emitted from said laser crystal into the combustion chamber of the internal combustion engine; and an integrated optical laser light sensor;

wherein said combustion chamber optical unit has a reflection surface facing towards said laser light sensor and said laser crystal, said reflection surface having a reflective mirroring such that at least a part of a laser light of the laser light pulses emitted by said laser crystal is reflected at said reflection surface towards said optical laser light sensor to be detected by said laser light sensor.

2. The laser spark plug as set forth in claim 1, wherein said combustion chamber optical unit includes a convergent lens, said convergent lens having said reflection surface.

3. The laser spark plug as set forth in claim 2, wherein said reflection surface of said convergent lens is located in an edge region of said convergent lens.

4. The laser spark plug as set forth in claim 1, further comprising an optical aperture connected upstream of said laser light sensor with respect to a direction of a beam path of the reflected laser light from the reflection surface incident in said laser light sensor.

5. The laser spark plug as set forth in claim 1, further comprising an integrated optical stray light sensor for detecting at least a part of a stray light scattered back during the laser light pulses by the combustion chamber optical unit.

6. The laser spark plug as set forth in claim 5, wherein said combustion chamber optical unit includes a combustion chamber window having a coupling-in surface delimiting the combustion chamber, said stray light sensor being configured to detect at least a part of the stray light scattered back from said coupling-in surface.

7. The laser spark plug as set forth in claim 5, further comprising an evaluation unit for comparing light intensities of the reflected laser light detected by said laser light sensor and the stray light detected by said stray light sensor.

8. The laser spark plug as set forth in claim 7, wherein said evaluation unit is configured to determine and output a difference value with respect to the light intensities of the detected reflected laser light and the detected stray light.

9. The laser spark plug as set forth in claim 1, wherein said reflection surface is curved.

10. An internal combustion engine comprising:

a combustion chamber; and said laser spark plug as set forth in claim 1 for igniting said combustion chamber.

11. The internal combustion engine as set forth in claim 9, wherein said internal combustion engine is a gas engine.

12. A method of ascertaining an operating condition of the laser spark plug as set forth in claim 1, comprising:

coupling the laser light pulses emitted from the laser crystal of the laser spark plug into the combustion chamber by the combustion chamber optical unit; and detecting a part of the laser light reflected at the reflection surface of the combustion chamber optical unit during the laser light pulses by the integrated optical laser light sensor.

13. The method as set forth in claim 12, further comprising:

coupling the radiation of a pump laser into the laser crystal, the ignition energy being afforded by the laser crystal; and adjusting the ignition energy by adjusting at least one of a pump output and a pump duration of the pump laser.

14. The method as set forth in claim 13, wherein said adjusting of at least one of a pump output and a pump duration of the pump laser is performed by adjusting a current strength of a pump current feeding the pump laser.

15. The method as set forth in claim 12, further comprising detecting at least a part of the stray light scattered back during the laser light pulses by an integrated optical stray light sensor.

16. The method as set forth in claim 15, wherein the at least a part of the stray light is scattered back during the laser light pulses by a combustion chamber window of the combustion chamber optical unit.

17. The method as set forth in claim 15, further comprising comparing light intensities of the reflected laser light detected by the laser light sensor and the stray light detected by the stray light sensor by an evaluation unit.

18. The method as set forth in claim 17, further comprising outputting a difference value with respect to the light intensities of the detected reflected laser light and detected stray light.

19. The method as set forth in claim 17, further comprising drawing a conclusion about a transmittance of the combustion chamber optical unit depending on a result of said comparing, and adjusting an ignition energy depending on the transmittance of the combustion chamber optical unit.

20. The method as set forth in claim 19, wherein the conclusion is drawn about the transmittance of a combustion chamber window of the combustion chamber optical unit.

* * * * *